United States Patent [19]

Linton et al.

[11] Patent Number: 4,530,194

[45] Date of Patent: Jul. 23, 1985

[54] BRACKET

[75] Inventors: Derek Linton; Pam M. Linton, both of Marlow, England

[73] Assignee: Linton Systems Limited, England

[21] Appl. No.: 458,214

[22] Filed: Jan. 17, 1983

[30] Foreign Application Priority Data

Sep. 21, 1982 [GB] United Kingdom ..... 8226960

[51] Int. Cl.[3] ..... E04B 1/38

[52] U.S. Cl. ..... 52/712; 52/264; 52/281; 52/295; 52/309.4; 403/219

[58] Field of Search ..... 52/264, 265, 292, 293, 52/294, 295, 298-299, 274, 280, 281, 282, 712, 713, 309.4, 309.5, 288, 506, 727; 403/174, 178, 219

[56] References Cited

U.S. PATENT DOCUMENTS

| | | | |
|---|---|---|---|
| 974,606 | 11/1910 | Schrader | 403/219 |
| 1,893,636 | 1/1933 | Ridgway | 52/281 |
| 2,092,751 | 9/1937 | Davis | 52/712 |
| 2,099,470 | 11/1937 | Coddington | 52/727 |
| 2,104,870 | 1/1938 | Levy | 52/264 |
| 2,143,288 | 1/1939 | Stolz | 52/274 |
| 2,911,817 | 11/1959 | Smith et al. | 52/293 |
| 3,170,269 | 2/1965 | Dunnington | 52/293 |
| 3,256,030 | 6/1966 | Banse | 52/712 |
| 3,353,863 | 11/1967 | Koot | 52/264 |
| 3,411,252 | 11/1968 | Boyle, Jr. | 52/295 |
| 3,413,773 | 12/1968 | Fitzgerald | 52/295 |
| 3,462,897 | 8/1969 | Weinrott | 52/265 |
| 3,677,874 | 7/1972 | Sterrett et al. | 52/309.4 |
| 4,063,395 | 12/1977 | Stewart et al. | 52/309.5 |

FOREIGN PATENT DOCUMENTS

| | | | |
|---|---|---|---|
| 2951098 | 7/1980 | Fed. Rep. of Germany | 52/712 |
| 440423 | 12/1935 | United Kingdom . | |
| 631404 | 11/1949 | United Kingdom . | |
| 722274 | 1/1955 | United Kingdom . | |
| 1101996 | 2/1968 | United Kingdom . | |
| 1214204 | 12/1970 | United Kingdom . | |
| 1551708 | 8/1979 | United Kingdom . | |
| 2033044 | 5/1980 | United Kingdom . | |

*Primary Examiner*—John E. Murtagh
*Assistant Examiner*—Andrew Joseph Rudy
*Attorney, Agent, or Firm*—Klarquist, Sparkman, Campbell, Leigh & Whinston

[57] ABSTRACT

A bracket 13 for use at a node point in a framework between two horizontal members 11, 11' and vertical member 12, said bracket comprising a first channel member 19 having a base 20 and two upstanding side walls 23, 25, the longitudinal axis of which is aligned with the axis of said two horizontal members, said channel member 19 being provided with means defining two transverse partition walls 27, 28 defining a space within the first channel member intermediate the ends thereof for accommodating the base of the substantially vertical member 12, and defining spaces between the partition walls and the ends of the channel to accommodate the ends of the horizontal members, a further element 14 being provided for mounting said channel member 19 on a sub-structure 1.

30 Claims, 4 Drawing Figures

BRACKET

BACKGROUND OF THE INVENTION

The present invention relates to a bracket, and more particularly the present invention relates to a bracket intended to be used at a node point between horizontal and vertical frame members.

In particular the invention relates to a bracket suitable for use in forming a framework, which framework can constitute a structural portion of a building, such as a house, hospital, school or the like.

At the present time there is a need for a building system that will enable houses, hospitals, schools and other buildings to be built rapidly, the resultant buildings having a high degree of thermal insulation to minimise running costs.

It has been proposed to provide structures, such as houses, schools and the like by erecting a steel framework to form the "skeleton" of the building. Difficulties are encountered in connecting the members of such a framework together, so that the frame has a controlled tension, and in connecting the members of the framework to a sub-structure such as a concrete raft or a lower portion of the framework.

OBJECT OF THE INVENTION

The present invention seeks to provide an improved bracket which will facilitate the connecting of frame members of this type, and in utilising a bracket in accordance with the present invention it has been found possible to use structural members formed from a cold rolled box section, filled with a foamed plastics material to minimise any risk of corrosion and also to provide the members with a high degree of thermal-insulation.

BRIEF SUMMARY OF THE INVENTION

According to the broadest aspect of this invention there is provided a bracket for use at a node point in a framework between two horizontal members and a vertical member, said bracket comprising a first channel member having a base and two upstanding side walls, the longitudinal axis of which is aligned with the axis of said two horizontal members, said channel member being dimensioned to accommodate the base of the substantially vertical member, and also to accommodate the ends of the horizontal members, between the vertical member and the ends of the channel, means being provided for mounting said channel member on a sub-structure.

Preferably the side walls of said channel are provided with a plurality of apertures to enable fastening means, such as blind-rivets, to be engaged with at least the horizontal members located within the channel.

In preferred embodiments of the invention the means for fastening the bracket to a sub-structure comprise an element secured, such as by welding, to the underneath of the base of the said channel member, and, in one embodiment said element comprises a "L" sectioned strip, a first arm of the strip being aligned with one side wall of the channel but extending away therefrom, a second arm of the strip abutting the base of the channel and protruding laterally beyond the other side wall of the channel.

One arm of the strip (e.g. the first arm) may be provided with apertures and the other arm of the strip (e.g. the second arm) may be provided with notches in the free edge thereof to enable the bracket to be mounted on mutually perpendicular studs protruding from a concrete raft or the like.

Preferably the arms of the channel member are inclined inwardly.

This invention also relates to a framework comprising at least one bracket as described above and a plurality of frame members connected thereto.

Preferably each said frame member comprises a cold rolled box section, which may be rolled from steel treated to minimise corrosion, such as pre-galvanised steel. Conveniently each cold rolled box section is provided with a lock seam and is thus formed from a single sheet, and advantageously each said cold rolled box section is filled with a substantially rigid foamed plastics material, such as a polyurethane foam a polyisocyanurate foam or a phenolic resin based foam. The frame members may be provided with apertures to receive fastening means, such as blind-rivets.

Conveniently each frame member is of substantially square or rectangular section, two opposed faces having the central regions there of being recessed.

A membrane may be secured to one face of the completed framework, said membrane being formed from a cross laminate of orientated high density polyethylene.

A foamed plastics material such as polyurethane foam, or a phenolic resin based foam, may be applied to areas of said membrane to fill voids defined by the membrane and adjacent members of the framework.

Preferably the framework is secured to a concrete raft or the like by means of engagement between said bracket and a support plate embedded in the raft. The support plate may be associated with foundation bolts, which are embedded in the raft.

Conveniently said support plate is embedded in the raft by initially forming the base of a raft, and subsequently supporting the support plate and the associated foundation bolts in a desired position relative to the base of the raft and filling the interspace between the base of the raft and the support plate with concrete, and permitting that concrete to cure.

Advantageously members are connected to said support plate to act as formwork to define the volume of concrete poured, at least some of said members being removable after the concrete has cured.

The framework may support a roof and may thus constitute a building. The external face of the framework may be clad, for example by means of a conventional wall built spaced therefrom, or with plaster or other rendering.

It will be appreciated that by utilising brackets in accordance with the present invention a framework can rapidly be constructed from elongate elements formed as cold rolled box sections of mild steel, for example, appropriately treated to minimise corrosion, the cold rolled box section members being filled with a rigid foam material. It has been found that if an appropriate cross section is utilised, such members can be very strong, even though the steel utilised is very thin. Thus the members will be light, relatively inexpensive, and because they are filled with foam, will exhibit excellent thermal insulation properties. By utilising brackets in accordance with the present invention such members can rapidly and securely be connected to the brackets, for example by means of "blind-rivets" providing a strong and stable structure. If the framework constituting this strong and stable structure is then provided with the membrane of polythene, or a corresponding membrane, and a foam plastics material is applied to the membrane, the resulting structure has substantial stength, excellent thermal insulation properties, and can be very rapidly assembled. Such a structure forms an ideal "skeleton" for a building and enables buildings to be built rapidly and cheaply, but yet have excellent thermal insulation properties.

It is envisaged that it will be quite feasible for a framework as outlined above to be utilised as the "skeleton" of a two or three storey building, but it is to be understood that if buildings of greater height are to be built, a similar framework may be utilised reinforced, where necessary, by a primary skeleton formed from RSJ's.

It is envisaged that, in utilising a building system as described hereinafter in greater detail, the principal components will be manufactured under factory conditions, the elongate structural members to form the framework all being manufactured to have standard lengths, and the appropriate brackets being manufactured to have appropriate dimensions. All the appropriate components for a particular building can then rapidly be transferred to the selected site, and once the initial concrete raft has been laid, the principal "skeleton" of the building can be rapidly erected, usually within a matter of hours, or days at the most. Then the membrane can be applied to the exterior of the "skeleton" of the building, and a roof can be mounted on the "skeleton" thus enclosing the interior of the building from the weather, and facilitating the subsequent construction of the building.

INTRODUCTION OF THE DRAWINGS

In order that the invention may be more readily understood, and so that further features thereof may be appreciated, the invention will now be described by way of example with reference to the accompanying drawings in which.

DESCRIPTION OF PREFERRED EMBODIMENT

Figure 1:
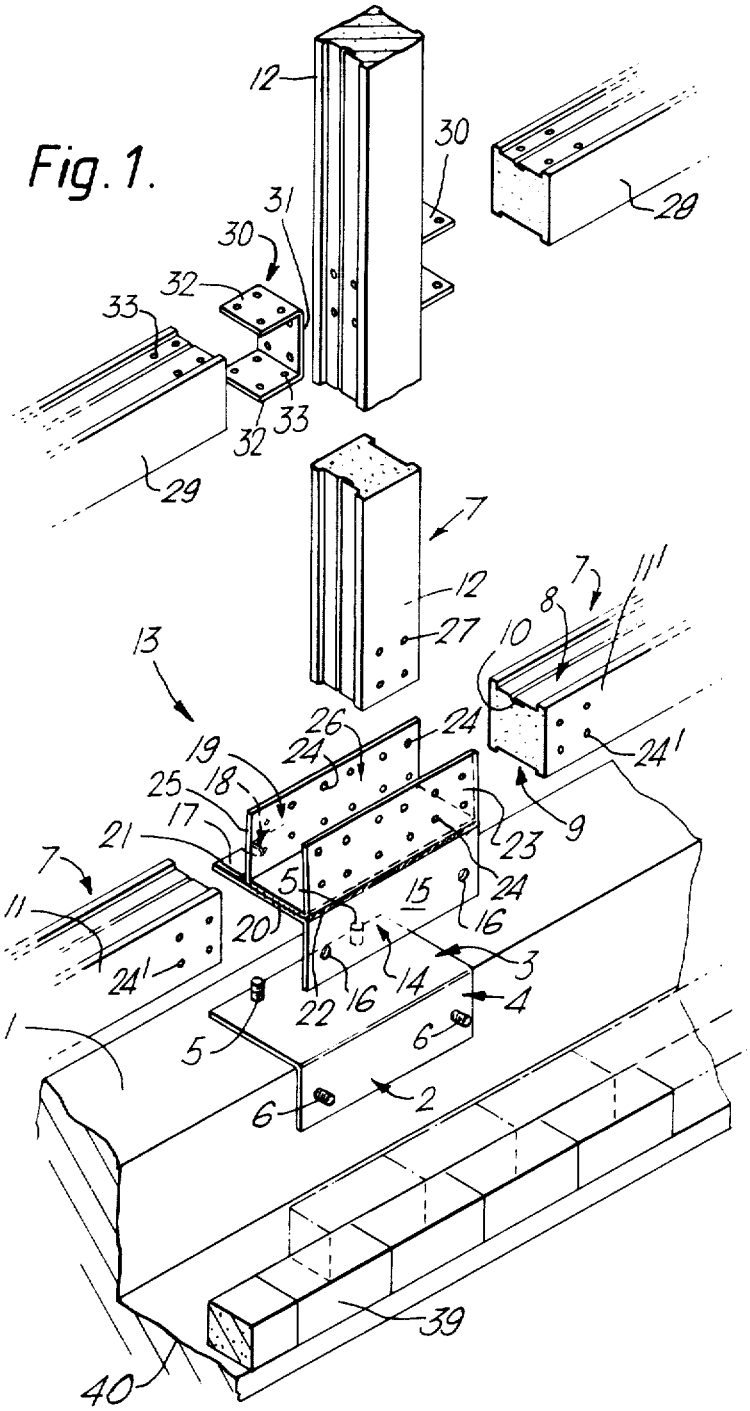
FIG. 1 is an exploded perspective view of part of framework that forms a building structure, showing a connector in accordance with the invention.

Referring to FIG. 1, when a building is to be constructed, initially a concrete raft 1 is prepared. The raft may be a rectangular raft extending over the entire floor plan of the building to be constructed, or may merely extend around the periphery of the building. Of course the raft may be of any other shape, such as "L" or "H" shaped. Embedded into the raft, at appropriate locations, are a plurality of support plates 2, (by a method that will be described hereinafter) each such support plate having a horizontal portion 3 on the upper surface of the raft, flush with that upper surface and a vertical portion on a vertical side wall of the raft, and flush with that side surface. Foundation bolts 5, 6 are embedded in the raft, and the threaded ends of these foundation bolts protrude vertically and horizontally from these support plates 2.

A framework is then assembled on the raft, the framework being connected to the raft by being secured to the support plates 2. The framework is created from elongate elements 7 which are all of the same cross-section and may preferably all be of standard lengths. Thus it will be appreciated that when a building is to be constructed the elongate elements 7 can be prefabricated in a factory, and cut to various standard lengths the appropriate number elements then being transported to the building site. The elements can be rapidly assembled to form the framework since each element is interchangeable with any other element.

Each element 7 is a hollow cold rolled lock seamed tube formed from hot dipped galvanised mild steel. The tube is of substantially square cross-section, but two elongate recesses 8, 9 are formed in two opposed faces of the tube so that the tube is of generally "H" cross-section and the lock seam 10 is located in the base of one of these recesses 8. The tube may be entirely filled with a substantially rigid foamed plastics material. This may be a polyurethane foam or any other appropriate foam, and examples of appropriate foams will be specified hereinafter. A tube of this construction may be fabricated from relatively thin galvanised mild steel but will have substantial strength and will also have excellent thermal insulation properties by virtue of the foam filling for the tube.

It is to be appreciated that whilst the tube has been specified as being manufactured from hot dipped galvanised mild steel, the galvanising merely provides the mild steel with corrosion resistant properties, and the tube may be treated in any appropriate way to provide corrosion resistance or may be fabricated from any appropriate corrosion resistant material.

As shown in FIG. 1 two lower horizontal elongate elements 11, 11' and one vertical element 12 must be interconnected at a single node point immediately adjacent the support plate 2. The bracket 13 facilitates the construction of such a node point.

The bracket 13 comprises a first member 14 consisting of a strip of "L" section. One arm of the "L", 15 is adapted to be vertical and is adapted to be located in position in abutment against the vertical face 4 of the support plate 2. This vertical arm 15 is provided with two apertures 16 which are adapted to be located over the foundation bolts 6 that protrude horizontally from the vertical face 4 of the support plate 2. The second arm 17 of the "L" sectioned member 14 is adapted to lie horizontally on top of the support plate 2, and the rear edge of this arm 17 is notched 18 so that, as the bracket 13 is moved so the horizontal threaded ends of the foundation bolts 6 pass through the apertures 16, the vertically extending threaded ends of the foundation bolts 5 on the support plate 2 pass through the notches 18. Appropriate washers and nuts can then be located on the threaded ends of the foundation bolts and tightened thus securely mounting the bracket 13 in position.

Welded or otherwise secured to the top of the arm 17 of the first member 14 is a channel member 19. The channel member 19 has a flat base 20 secured to the top of the arm 17, for example by appropriate welds 21, 22. One outstanding side wall 23 of the channel 19 is flush with the front of the arm 15 of the "L" sectioned member 14. A plurality of apertures 24 is provided in this wall 23 of the channel and also in the other upstanding wall 25 of the channel. The upstanding walls 23, 25 may convege slightly towards one another.

It can be seen that, when a node point is to be constructed, once the bracket 13 has been mounted in position on the support plate 2, the vertical elongate element 12 can be inserted into the central space 26 defined by the channel member 19. When the end of the elongate element 12 has been inserted in position, it can be secured in position by means of "blind-rivets" or the like which are mounted in position through the apertures 24 in the walls 23 and 25 of the channel member 19. Apertures 27 may be provided in the elongate elements to receive the "blind-rivets". The two horizontal elongate elements 11, 11' can then be located in the portions of the channel member 19 located on either side of the centrally located further section of channel 26, and again these horizontal members can be secured in position by appropriate means (such as "blind-rivets") introduced through the apertures 24 in the side walls 23, 25 of the channel 19.

Thus a node point between two horizontal frame members 11, 11' and a vertical frame member 12 can readily and rapidly be created, the resultant node point being neat and serviceable, the frame members all being securely connected to the underlying sub-structure, i.e. the raft 1. Further frame members, such as horizontal upper frame members 28, 29, may then be connected to the upper portion of the upright member 12 by means of "U" shaped brackets 30. Each bracket 30 has a base 31 dimensioned to be received in a recess formed on one face of the vertical frame member 12, and two horizontal arms 32, to be received in the recesses on the horizontal member 29. Appropriate apertures 33 are provided to receive "blind-rivets" to complete the connection.

Figure 2:
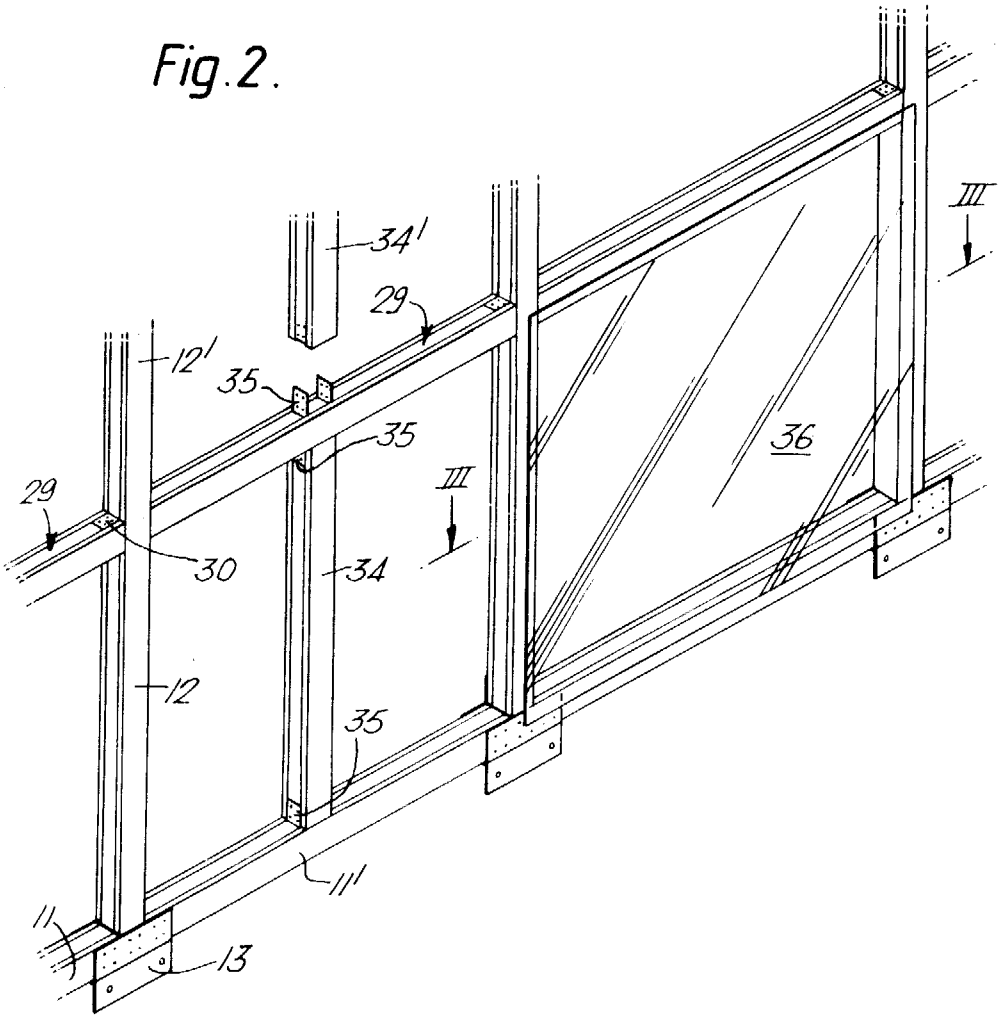
FIG. 2 is a perspective view of a larger part of the assembled framework as illustrated in FIG. 1.

A frame work such as the framework shown schematically in FIG. 2 can therefore be constructed, although it is to be appreciated that additional transverse re-inforcing frame members, such as the member 34 can be added to the framework, if so desired, the reinforcing members being connected to the members illustrated by means of "U" shaped connecting brackets 35 provided with appropriate apertures to receive appropriate fastening means such as "blind-rivets". One "U" shaped bracket 35 is shown connected, by means, for example, of "blind-rivets" passing through apertures in the base of the "U" shaped bracket, to the horizontal member 29 ready to receive a further reinforcing member 34', which can then be securely mounted in position with, for example, "blind-rivets" passing through apertures in the two side arms of the "U" shaped bracket 35.

The framework, as finally completed, will of course define appropriate apertures to receive windows, doors and the like.

When the framework has been completed, the framework may define merely the exterior wall of the building or structure, or may also define one or more interior walls. One surface of each wall is then provided with a sheet 36 of appropriate material, and the function of this sheet will become clear from the following description. Preferably the sheet is of translucent polythene and may be a cross laminate of oriented high density polythene as sold under Trade Mark "Valeron" by Van Leer (U.K.) Ltd. of Ellesmere Port, Liverpool. The sheet is secured in position to extend across all the apertures defined by the framework, and is preferably located on the exterior of the framework, so that the sheet then defines the outer-most surface of the structure. The sheet may be held in position by means of double-sided adhesive tape 37.

A roof can rapidly be assembled, in a conventional way, on top of the framework and then the structure is weather-proof.

A sprayed foam material, such as sprayed polyurethane foam or sprayed polyisocyanurate foam may then be sprayed, from the interior of the framework, onto the polythene sheet. An initial thin spray of foam is applied which as a result of the heat generated during the foaming process, bonds firmly to the polythene sheet and rapidly cures or solidifies. One or more subsequent layers of foam can be provided until the entire interspace defined by the frame members and the polythene sheet is filled with foam material 38, apart from those regions of the framework that define apertures to accommodate doors or windows, and the inner surface of the foam is flush with the inner surfaces of the various frame members. Internal cladding, such as conventional dry lining, can be mounted in position on the interior of the walls and an appropriate external cladding can be provided. The external cladding may be of any desired form, but in FIG. 1 it can be seen that an outer brick wall 39 can be constructed on a protruding lip 40 of the raft 1 or on corresponding footings to provide a cavity wall, the building then having the external appearance of a conventional brick building.

A building constructed by the method described above can be constructed very rapidly, and thus very cheaply, but the resultant building will have excellent thermal insulation properties.

The insulating foam utilised may be any convenient foam, but reference may be made to a polyurethane foam, the components of which are sold under the Trade Mark "Isofoam" by The Baxendon Chemical Company Limited of Accrington, Lancashire. The foam is created by mixing an isocyanate and a polyol. Grade SS212 may be found suitable for spraying, and grade RM114 may be found suitable for injection into the hollow box sections constituting the frame members. Such a foam may easily be treated to have fire resistance properties. However, phenolic resin based foams may be used which have very low class 0 fire resistance properties.

Figure 3:
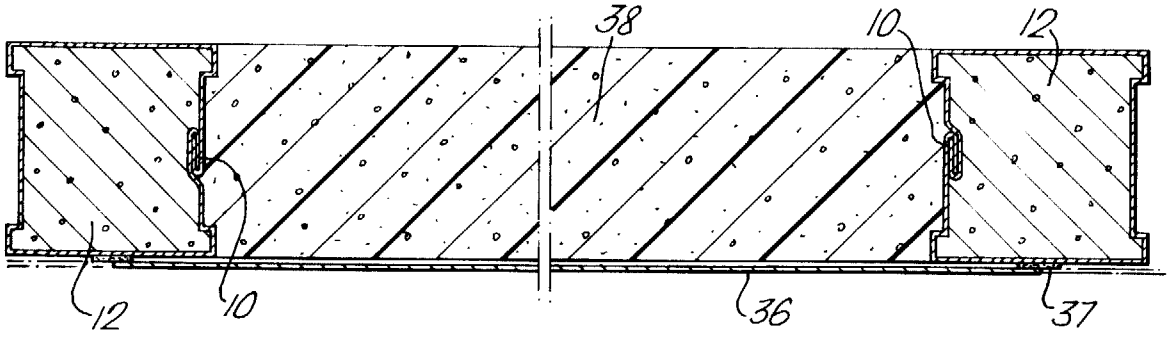
FIG. 3 is a horizontal sectional view through part of the framework of FIG. 2, taken on the line III—III of FIG. 2.

It is to be noted, from Fig. 3, that the lock seams 10 of the various members forming the frame work are so located that when the foam material 38 has been sprayed onto the polyethylene sheet 36 the foam material covers the lock seam 10, thus minimising any risk of corrosion commencing at this point.

Of course, all the metallic components of the framework may be treated, as mentioned above, to minimise any risk of corrosison, but such parts that are not covered by the foam material, such as the exterior portions of the bracket 13, may be coated with an appropriate material, such as bitumastic paint after the framework has been assembled.

Figure 4:
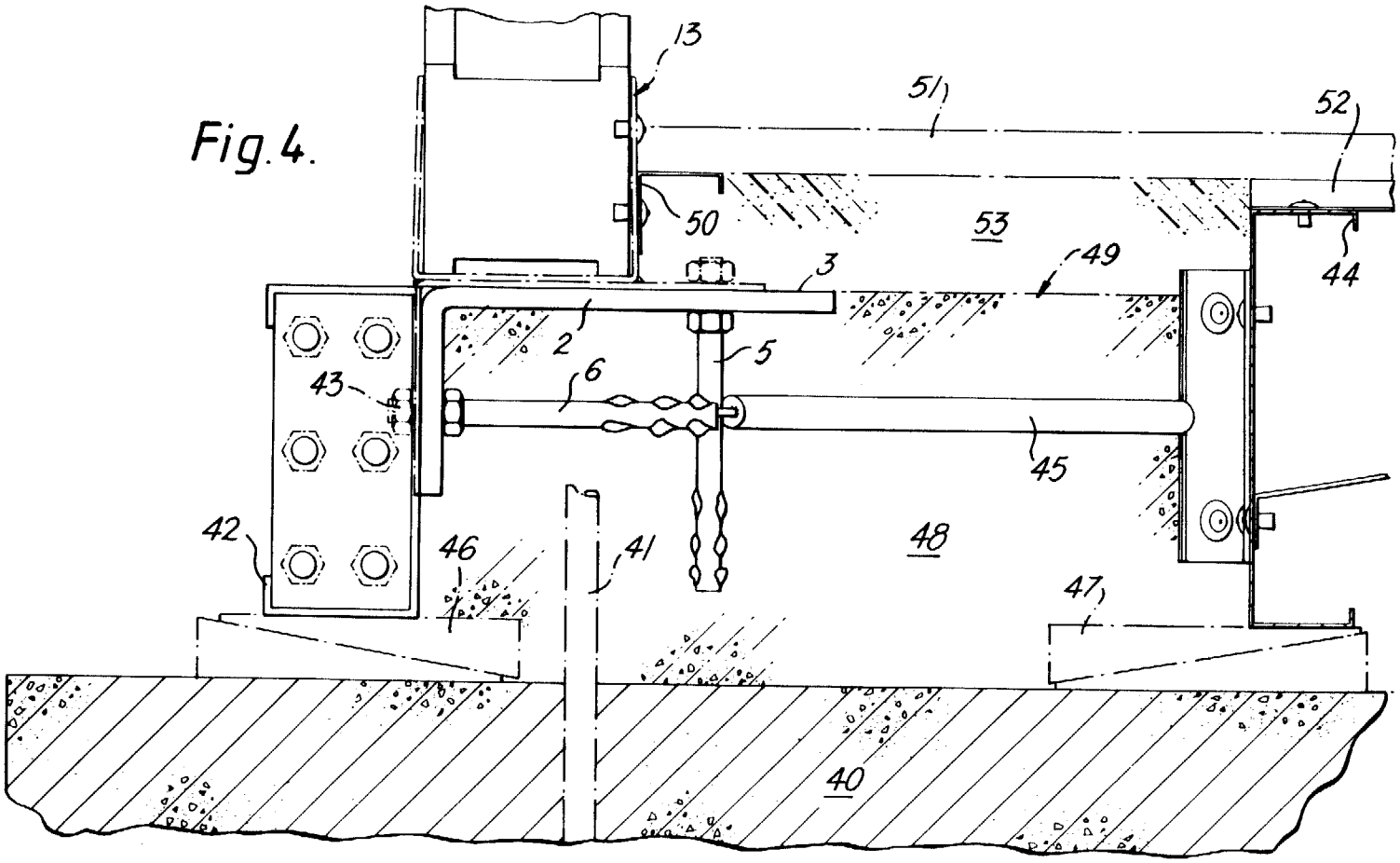
FIG. 4 is a sectional figure showing how the support plate 2 is connected to the raft.

Referring now to FIG. 4, the method of affixing the support plate 2 to the raft 1 will now be described. Initially when preparing the raft footings are dug in the ground, the footings extending around the outer periphery of the area where the raft is to be formed. Optionally footings can be provided within the area of the raft where load bearing walls are to be provided. The footings and the area between the footings are then filled with concrete to form a raft 40, there being a number of reinforcing rods 41 extending upwardly from the raft.

Subsequently the support plates 2 are shown in FIG. 4 is located in the position that the support plates are to adopt on the completed raft. The foundation bolts 5 and 6 are located in position.

To locate the support plate 2 that is shown in FIG. 4 in position an elongate channel section member 42 is located in position on the exposed stud of the foundation bolts 6 and is retained in position by means of a nut 43. A similar, but narrower gauge, channel section member 44 is similarly located in a position parallel with the channel 4 but spaced inwardly from the periphery of the raft. The channel member 44 is connected to the assembly of the support plate 2 and the bolts 5 and 6 by means of a tie rod 45. The channel section members 42 and 44 are both supported by cooperating wedge arrangements 46, 47 which can be adjusted to ensure that the vertical flanges of the channel members 42 and 44 are vertical and that the channel members adopt the desired position. The interspace between the vertical flanges of the channel members 42 and 44 can then be filled with concrete 48 to a level 49 which is flush with the top of the uppermost surface of the horizontal part 3 of the support plate 2. The concrete then cures. Thus the foundation bolts 5 and 6 become embedded in concrete. The channel member 42, having acted as a formwork, can then be removed. It will thus be appreciated that the concrete 48 extends entirely around the periphery of the raft 40.

FIG. 4 illustrates in phantom a support bracket 13 in accordance with the invention in position on the support plate 2 and also shows a clip 50 attached to one part of the support bracket 13 which is utilised to support a sheet of chip-board 51 which can form a floor of a building. The sheet of chipboard 51 rests, in cooperation with appropriate packing 52, on the upper horizontal flange of the channel section member 44.

The interspace 53 between the chipboard and the uppermost surface of the concrete 48 may be filled with foam, and foam may also be injected between the uppermost surface of the raft 40 and the chipboard constituting the floor both to add support to the floor and to add insulating properties to the complete structure.

It is to be emphasised that when a building is constructed by the method described above, once the raft has been constructed, the framework can be rapidly assembled, the roof can be mounted in position on the framework, and the polythene sheet can be mounted in position on the framework within a matter of days. The interior of the building is then fully protected from the weather and, when the spray has been applied to the polythene, which is again a step that can be performed rapidly, work can commence on the interior fitting of the building. Simultaneously work can commence on the construction of an outer wall 39, if such an outer wall is to be provided. It is to be understood that in certain circumstances it may be suitable to apply plaster on some other rendering directly to the exterior of the wall, constituted by the framework and the foam material 38. If this course of action is to be adopted appropirate laths, or the equivalent, are connected to the wall, and the plaster or rendering is held by the laths.

Thus a builing as described above can be constructed rapidly, and therefore economically, from components that are prefabricated in a factory to within close tolerances. Thus the components can be manufactured under ideal conditions. It is envisaged that a building constructed as described above will have very good thermal insulation properties and will thus only require a minimum quantity of energy to maintain an even temperature within the building.

What is claimed is:

1. A bracket for use at a node point in a framework between two horizontal members and a vertical member, said bracket comprising a first rigid, preformed channel member having a base and two upstanding side walls, the longitudinal axis of which is aligned with the axis of said two horizontal members, said channel member being dimensioned to accommodate the base of the substantially vertical member, and also to accommodate the ends of the horizontal members on opposite sides of said vertical member, fastening means for fastening said vertical member and said horizontal members to said channel member in engagement with said base, and means being provided for mounting said channel member on a sub-structure, said mounting means including a first mounting arm extending outwardly of one side wall and a second mounting arm extending downwardly from the other side wall.

2. A bracket according to claim 1 wherein the side walls of said channel are provided with a plurality of apertures to enable fastening means to be engaged with at least the horizontal members located within the channel.

3. A bracket according to claim 1 wherein the means for mounting the bracket on a sub-structure includes an element secured to the underneath of the base of said channel member, said element comprising a "L" sectioned strip, a first arm of the strip being aligned with one side wall of the channel but extending away therefrom, a second arm of the strip abutting the base of the channel and protruding laterally beyond the other side wall of the channel.

4. A bracket according to claim 3 wherein one arm of the strip is provided with apertures and the other arm of the strip is provided with notches and the free edge thereof to enable the bracket to be mounted on mutually perpendicular studs protruding from a concrete raft or the like.

5. A bracket according to claim 3 wherein said first arm is provided with said apertures and the second arm is provided with said notches.

6. A bracket according to claim 1 wherein the side walls of the channel member are inclined inwardly.

7. A framework comprising at least one bracket according to claim 1 and a plurality of frame members connected thereto.

8. A framework according to claim 7 wherein each said frame member comprises a cold rolled box section.

9. A framework according to claim 8 wherein each cold rolled box section is rolled from steel treated to minimise corrosion.

10. A framework according to claim 9 wherein each cold rolled box section is rolled from pre-galvanised steel.

11. A framework according to claim 8 wherein each cold rolled box section is provided with a lock seam and is thus formed from a single sheet.

12. A framework according to claim 8 wherein each said cold rolled box section is filled with a substantially rigid foamed plastics material.

13. A framework according to claim 12 wherein said foamed plastics material comprises a polyurethane foam, or polyisocyanurate foam.

14. A framework according to claim 12 wherein the foamed plastics material comprises a phenolic resin based foam.

15. A framework according to claim 7 wherein each frame member is of substantially square or rectangular section, two opposed faces having the central regions thereof recessed.

16. A framework according to claim 7 provided with a membrane secured to one face thereof.

17. A framework according to claim 16 wherein said membrane is formed from a cross laminate of orientated high density polyethylene.

18. A framework according to claim 16 wherein foamed plastics material is applied to areas of said membrane and fills voids defined by the membrane and adjacent members of the framework.

19. A framework acording to claim 16 wherein the foamed plastics material is polyurethane foam, or polyisocyanurate foam.

20. A framework according to claim 18 wherein the foamed plastics material is a phenolic resin based foam.

21. A framework according to claim 7 wherein the framework is secured to a concrete raft or the like by means of engagement between said bracket and a support plate embedded in the raft.

22. A framework according to claim 21 wherein said support plate is associated with foundation bolts, which are embedded in the raft.

23. A framework according to claim 22 wherein said support plate is embedded in the raft by initially forming the base of a raft, and subsequently supporting the support plate and the associated foundation bolts in a desired position relative to the base of the raft and filling an interspace between the base of the raft and the support plate with concrete, and permitting that concrete to cure.

24. A framework according to claim 23 wherein members are connected to said support plate to act as formwork to define a volume of concrete poured, at least some of said members being removable after the concrete has cured.

25. A framework according to claim 8 wherein the framework supports a roof and thus constitutes a building.

26. A building according to claim 25 wherein the external face of the framework is clad.

27. A building according to claim 26 wherein the external face of the framework is clad by means of a conventional wall built spaced therefrom.

28. A bracket for use at a node point in a framework between two horizontal members and a vertical member, said bracket comprising a first channel member having a base and two upstanding side walls, the longitudinal axis of which is aligned with the axis of said two horizontal members, said channel member being dimensioned to accommodate the base of the substantially vertical member, and also to accommodate the ends of the horizontal members, between the vertical member and the ends of the channel, and means being provided for mounting said channel member on a sub-structure and said means including an element secured to the underneath of the base of said channel member where said element comprises a "L" sectioned strip, a first arm of the strip being aligned with one side wall of the channel but extending away therefrom, a second arm of the strip abutting the base of the channel and protruding laterally beyond the other side wall of the channel.

29. A bracket according to claim 28 wherein one arm of the strip is provided with apertures and the other arm of the strip is provided with notches and the free edge thereof to enable the bracket to be mounted on mutually perpendicular studs protruding from a concrete raft or the like.

30. A bracket according to claim 28 wherein said first arm is provided with said apertures and the second arm is provided with said notches.

* * * * *